US005768925A

United States Patent [19]

Ozawa et al.

[11] Patent Number: 5,768,925

[45] Date of Patent: Jun. 23, 1998

[54] ELECTRONIC-COMPONENT-INTEGRATED KEY

[75] Inventors: Takurou Ozawa; Yoshio Watanuki, both of Kanagawa, Japan

[73] Assignees: Alpha Corporation; Nissan Motor Co., Ltd., both of Kanagawa, Japan

[21] Appl. No.: 801,924

[22] Filed: Feb. 14, 1997

Related U.S. Application Data

[63] Continuation of Ser. No. 531,085, Sep. 20, 1995, abandoned.

[30] Foreign Application Priority Data

Sep. 29, 1994 [JP] Japan ..... 6-235494

[51] Int. Cl.[6] ..... E05B 19/04

[52] U.S. Cl. ..... 70/408; 70/278; 70/395

[58] Field of Search ..... 70/408, 278, 395

[56] References Cited

U.S. PATENT DOCUMENTS

| | | | |
|---|---|---|---|
| 4,200,227 | 4/1980 | Lemelson | 235/382 |
| 4,287,835 | 9/1981 | Brunken et al. | 70/395 |
| 4,562,712 | 1/1986 | Wolter | 70/456 R |
| 4,922,736 | 5/1990 | Tanaka et al. | 70/277 |
| 5,003,801 | 4/1991 | Stinar et al. | 70/278 |
| 5,117,097 | 5/1992 | Kimura et al. | 235/439 |
| 5,337,588 | 8/1994 | Chhatwal | 70/278 |
| 5,433,096 | 7/1995 | Janssen et al. | 70/278 |

FOREIGN PATENT DOCUMENTS

| | | |
|---|---|---|
| 2-156835 | 6/1990 | Japan . |
| 4-6462 | 1/1992 | Japan . |
| 4-79550 | 12/1992 | Japan . |
| WO 92/07156 | 4/1992 | WIPO . |

*Primary Examiner*—Rodney M. Lindsey
*Assistant Examiner*—Tuyet-Phuong Pham
*Attorney, Agent, or Firm*—Nikaido Marmelstein Murray & Oram LLP

[57] ABSTRACT

An electronic-component-integrated key has a head and a key plate. The head has an inside case portion, an outer sheath portion to be fixed to the inside case portion from outside, and a recessed portion that is formed in the inside case portion and arranged on the side of serrations of a key plate, not on the side of a head portion 1*a* of the key plate, so as to be substantially in parallel with the key plate. An electronic component is held within the recessed portion by a holder, and an abutment portion of the inside case portion is partially exposed to the outer surface of an opening formed in the outer sheath portion. During the process of manufacturing the electronic-component-integrated key, the following steps are taken when the key plate is arranged within a cavity of a mold. The key plate is fixed within the cavity by causing the abutment portion of the inside case portion to be abutted against the mold, and the outer sheath portion is thereafter formed on the outside of the inside case portion by charging molten resin into the cavity.

5 Claims, 6 Drawing Sheets

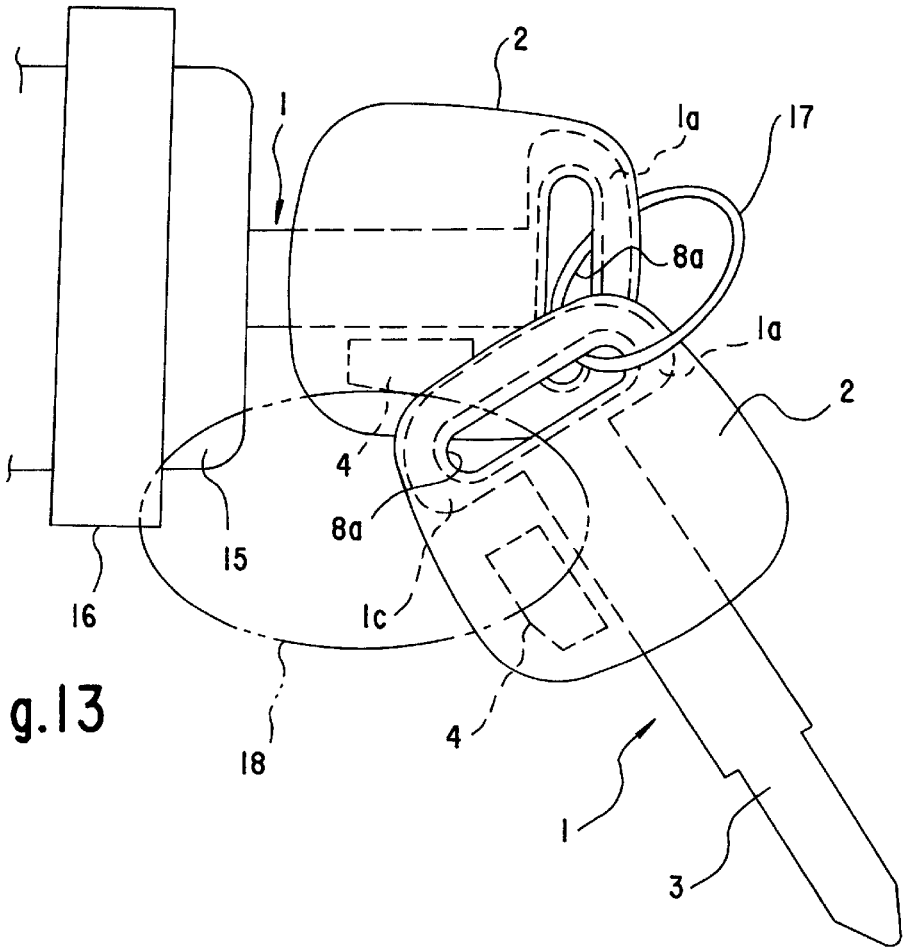
Fig.13
Fig.14
PRIOR ART
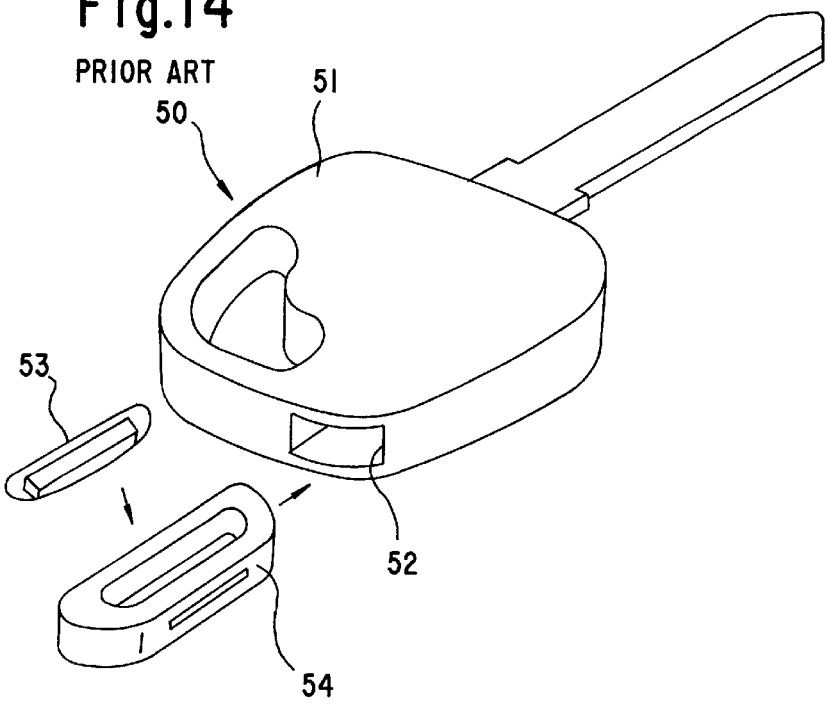

ELECTRONIC-COMPONENT-INTEGRATED KEY

This application is a continuation of application Ser. No. 08/531,085 filed Sep. 20, 1995, now abandoned.

BACKGROUND OF THE INVENTION

The invention relates to a key used for locking a lock system, and more particularly to an electronic-component-integrated key capable of incorporating an electronic component such as a transponder and a method of manufacturing such electronic-component-integrated key.

For example, a key for use in motor vehicles disclosed in Unexamined Japanese Utility Model Publication Hei-4-6462 includes: a key plate for mechanically unlocking a lock system; and a transmitter for unlocking the lock system by outputting an unlock signal that is propagated to the lock system through the air. This key has a watertight case that contains the transmitter and a base that has the key plate insert-molded therewith. The watertight case and the base are releasably coupled to each other. Such a key incorporates a transponder such as proposed, e.g., in Examined Japanese Patent Publication Hei-4-79550 or in Unexamined Japanese Patent Publication Hei-2-156835.

A conventional method of incorporating such transponder into the key is, as shown in FIG. 14, such that: a recessed portion 52 is formed in a head 51 of the key 50, the head being made of resin; a holder 54 for containing a transponder 53 is arranged inside the recessed portion 52; and the transponder 53 is then inserted by force or with an adhesive between the recessed portion 52 and the holder 54 to fix the holder 54.

The head shown in FIG. 14 is molded so as to cover the outer surface with soft resin so that the user can not only enjoy a gentle touch but also be protected from danger. The head is closed with a sliding mold so that the soft resin will not leak into the recessed portion 52 during molding. However, since the key must be fixed so as not to move in the key inserting direction at the time the sliding mold is inserted, the blade portion of the key is caused to be abutted against a mold die to regulate the moving of the key due to the sliding mold being inserted.

In the conventional key 50 shown in FIG. 14, the recessed portion 52 is formed at a position opposite to the blade portion of the key, and this arrangement allows key operating force to be directly applied to the recessed portion 52, from which arises a problem that the electronic component will be damaged while subjected to excessive mechanical deformation during the use of the key. In addition, since the recessed portion 52 is not covered with the soft resin, the passenger gets hurt when the passenger has his or her knee struck by the key. Moreover, the head 51, being covered with the soft resin, does not allow the mold to be abutted thereagainst. Therefore, the recessed portion 52 is necessarily arranged at the position opposite to the blade portion of the key. This arrangement also requires that an opening for passing a key holder ring or the like therethrough be formed at a position that is not at the center, thereby making it hard for the user to pass the ring through the opening. Still further, the aforementioned Unexamined Japanese Utility Model Publication No. Hei. 4-6462 proposes a key in which an electronic component is integrated in a head made of mold resin. This design requires screws for the assembly of the key.

SUMMARY OF THE INVENTION

The object of the invention is, therefore, to provide an electronic-component-integrated key that can be resin molded by causing a mold to reliably hold the key plate set within a cavity.

An electronic-component-integrated key of the invention has a key plate and a head. The key plate has a blade portion for forming serrations that serve to give a key code, and the head is made of resin and fixed to an end portion of the key plate. The head has an inside case portion and an outer sheath portion. The inside case portion is made of hard resin and has a recessed portion that is arranged on the side of the serrations of the key plate, not on the side of a head portion of the key plate, so as to be substantially parallel with the key plate. The outer sheath portion is fixed to the outside of the inside case portion and is made of soft resin. An electronic component is arranged within the recessed portion of the inside case portion. Abutment portions of the inside case portion are partially exposed to the inner surface of an opening formed in the outer sheath portion, the inner surface being on the side of the blade portion.

In the invention, the electronic component is held by a holder having elastic claws that are engaged within the recessed portion of the inside case portion. The inside case portion has a pair of case pieces. Elastic claws are formed on one of the case pieces of the inside case portion, whereas through holes are formed in the other case piece. The one case piece is retained by the other case piece while engaging the elastic claws of the one case piece with the through holes of the other case piece. The abutment portions of the inside case portion are exposed so as to be substantially flush with the outer sheath portion.

An electronic component, which is activated by a signal from the antenna of a lock system, is arranged within the recessed portion of the inside case portion. A hood portion is formed at the head portion of the key plate, the hood portion extending sideways from the blade portion and surrounding the electronic component in L-like form together with the blade portion.

A method of manufacturing an electronic-component-integrated key of the invention involves the steps of: attaching the inside case portion to the head portion of the key plate by setting the pair of case pieces to the head portion of the key plate; not only fixing the key plate to a cavity of a mold by arranging the key plate having the inside case portion attached thereto in the cavity and then causing the abutment portions of the inside case portion to be abutted against the mold, but also inserting a sliding mold into the recessed portion of the inside case portion; forming the outer sheath portion over the outside of the inside case portion by charging molten resin into the cavity; not only removing the sliding mold from the recessed portion of the inside case portion, but also separating the key plate from the mold; and inserting an electronic component into the recessed portion of the inside case portion. In an embodiment of the invention, a post is arranged adjacent to the mold after the blade portion of the key plate has been inserted into a receiving hole of the post, and then the head portion of the key plate is arranged within the cavity of the mold. The molten resin is charged between a plurality of abutment portions arranged substantially perpendicularly to the key plate, the molten resin serving to form the outer sheath portion. A stepped portion formed by the pair of case pieces when the inside case portion is attached to the head portion of the key plate is arranged within the cavity so as to be displaced from a gate for charging the molten resin for forming the outer sheath portion. Out of the pair of case pieces for forming the stepped portion, one case piece close to the gate is made thick and the other case piece remote from the gate is made thin. The soft resin is charged into the through holes formed in the other case piece of the inside case portion.

During manufacturing, the outer sheath portion is resin molded with the abutment portions of the inside case portion abutted against the mold (the abutment portions are exposed even after the inside case portion has been covered with the outer sheath portion). Therefore, the key plate can be fixed to the cavity stably during molding. In addition, the electronic component is arranged within the recessed portion formed in the inside case portion that is made of hard resin. Therefore, the electronic component can be protected from external force. Moreover, the outer sheath portion formed by soft resin can give a comfortable touch to the user and can protect the user from collision-related danger when the key is used as a key for motor vehicles. By engaging the elastic claws formed on the holder with the recessed portion of the inside case portion, the holder can be snapped to the head without screws.

If the openings of a plurality of electronic-component-integrated keys are coupled to each other with a ring and a single electronic-component-integrated key is inserted into the lock system, then the key plate is interposed between the antenna of the lock system and the electronic component of the other electronic-component-integrated key so that the key plate serves as a metal shielding member.

The stepped portion formed by the pair of case pieces is arranged inside the cavity so as to be displaced from the gate through which the molten resin is charged to form the outer sheath portion. Therefore, the amount of molten resin leaking into the interface between the pair of case pieces is small. This contributes to reducing the amount of molten resin leaking into the recessed portion, thereby allowing the recessed portion to be given a designed degree of dimensional accuracy.

BRIEF DESCRIPTION OF THE DRAWINGS

FIG. 13 is a side view showing a state in which one of a plurality of electronic-component-integrated keys of the invention coupled through a ring is inserted into a steering lock system; and FIG. 14 is an exploded perspective view of a conventional electronic-component-integrated key.

DETAILED DESCRIPTION OF THE PREFERRED EMBODIMENTS

Figure 1:
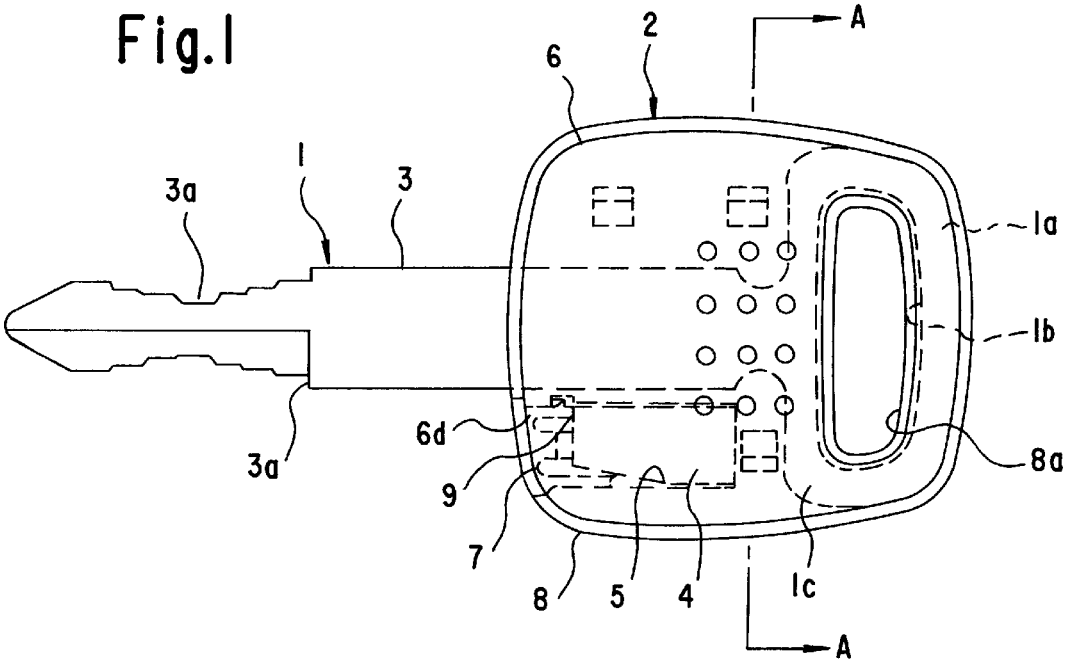
FIG. 1 is a plan view showing an electronic-component-integrated key, which is an embodiment of the invention.
Figure 2:
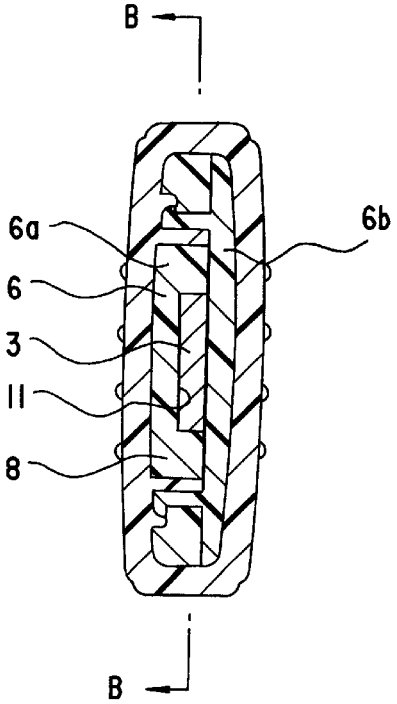
FIG. 2 is a sectional view taken along a line A—A of FIG. 1.
Figure 3:
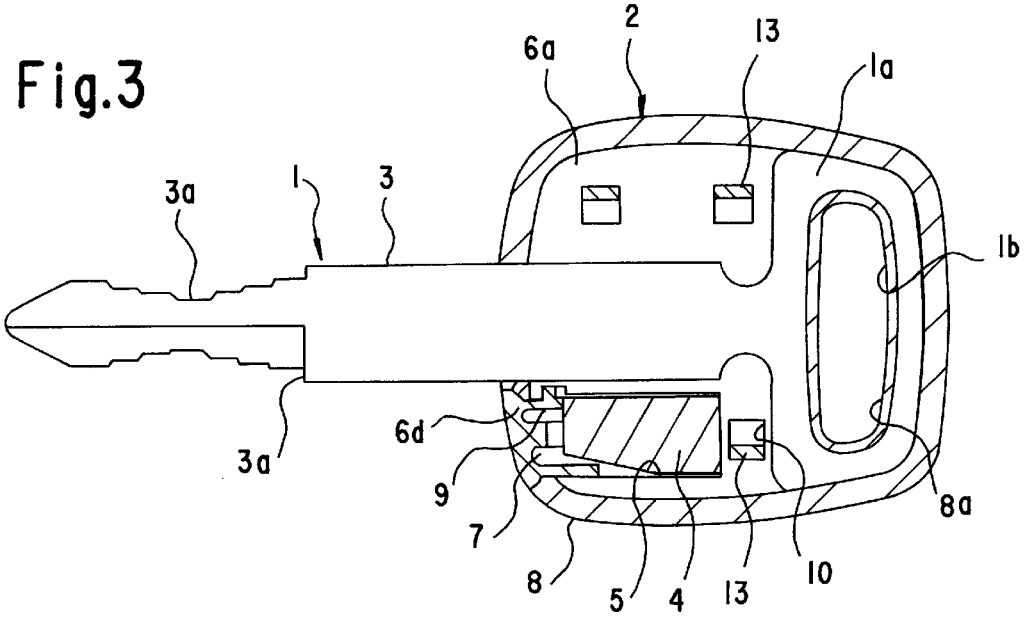
FIG. 3 is a sectional view taken along a line B—B of FIG. 2.

Electronic-component-integrated keys, which are the embodiments of the invention, will now be described with reference to FIGS. 1 to 13.

As shown in FIGS. 1 to 4, an electronic-component-integrated key of the invention includes: a key plate 1 and a head 2. The key plate 1 has a blade portion 3 with serrations 3*a* for giving a key code formed thereon. The head 2 is made of resin and fixed to an end portion of the key plate 1 including a head portion 1*a*. The key plate 1 has an annular hole 1*b* for inserting a key ring and is T-shaped by both the blade portion 3 and the head portion 1*a* that extends sideways from the blade portion 3. The head portion 1*a* is embedded inside the head 2. The head 2 includes an inside case portion 6, an outer sheath portion 8, and a holder 7. The inside case portion 6 is made of hard resin. The outer sheath portion 8 is not only fixed to the outside of the inside case portion 6 and to the outside of the hole in the head 2, but also made of soft resin. The holder 7, which is made of resin such as polypropylene, is to be inserted into a recessed portion 5 that is formed by the inside case portion 6 and the outer sheath portion 8 so as to be substantially parallel with the key plate 1.

Figure 7:
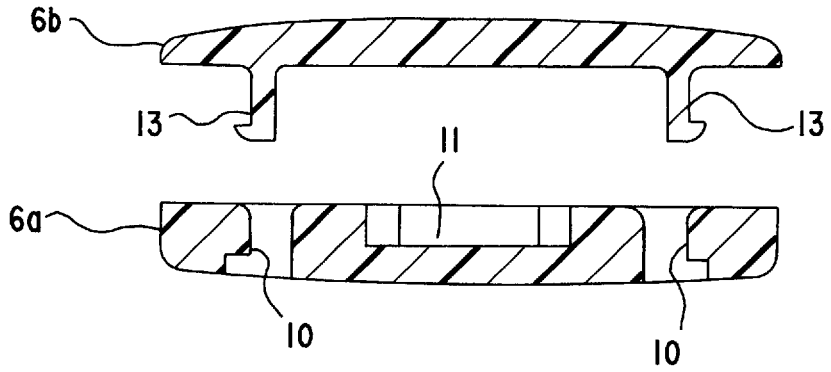
FIG. 7 is a sectional view taken along a line A—A of FIG. 5.
Figure 8:
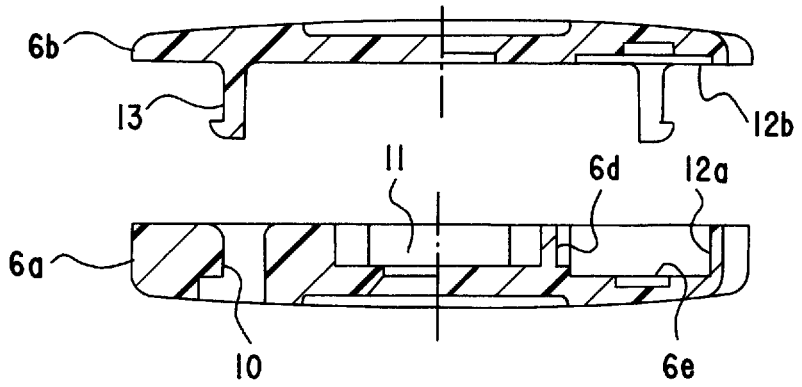
FIG. 8 is a sectional view taken along a line B—B of FIG. 5.
Figure 9:
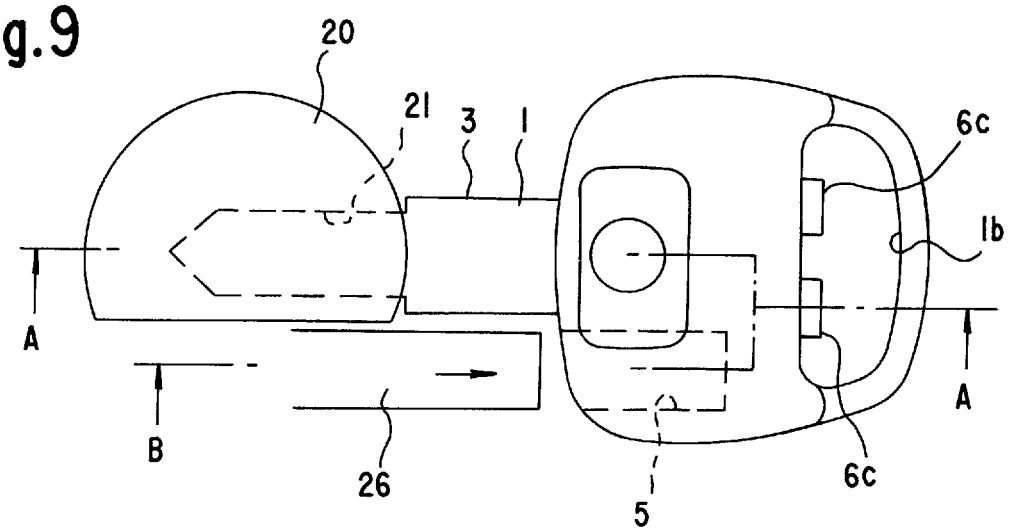
FIG. 9 is a plan view showing a state in which a key plate having a head attached thereto is inserted into a post.

To manufacture the key, a pair of case pieces 6*a*, 6*b* that constitutes the inside case portion 6 shown in FIGS. 5 to 8 is prepared. The pair of case pieces 6*a*, 6*b* is made by injection molding using hard resin such as polypropylene, polyacetal, or polycarbonate. The case piece 6*a* has three through holes 10, a groove 11 formed in the middle, a substantially rectangular slot 12*a*, and stepped portions 6*d*, 6*e*. The slot 12*a*is formed not only adjacent to the groove 11 but also closer to the blade portion 3 than the head portion 1*a* of the key plate 1. The stepped portions 6*d*, 6*e* are formed in the slot 12*a*. The case piece 6*b* has three elastic claws 13 and a slot 12*b*. The elastic claws 13 correspond to the three through holes 10 of the case piece 6*a*. The slot 12*b* corresponds to the slot 12*a* of the case piece 6*a*. When the case piece 6*a* is fitted over the case piece 6*b* after the key plate 1 has been set into the groove 11 as shown in FIGS. 7 and 8, the elastic claws 13 of the case piece 6*b* are snapped into the through holes 10 of the case piece 6*a*.

The recessed portion 5 is formed rather on the side of the serrations 3*a* of the key plate 1, not on the side of the head portion 1*a* of the key plate 1, so as to be substantially parallel with the key plate 1. Within the recessed portion 5 an electronic component 4 is held by the holder 7. The holder 7 has elastic claws 9 that are not only engageable with the stepped portions 6*d*, 6*e* within the recessed portion 5 of the inside case portion 6 but also elastically deformable. A portion 1*c* of the head portion 1*a* of the key plate 1 which extends toward the electronic component 4 surrounds the electronic component 4 in L-like form together with the blade portion 3.

Figure 4:
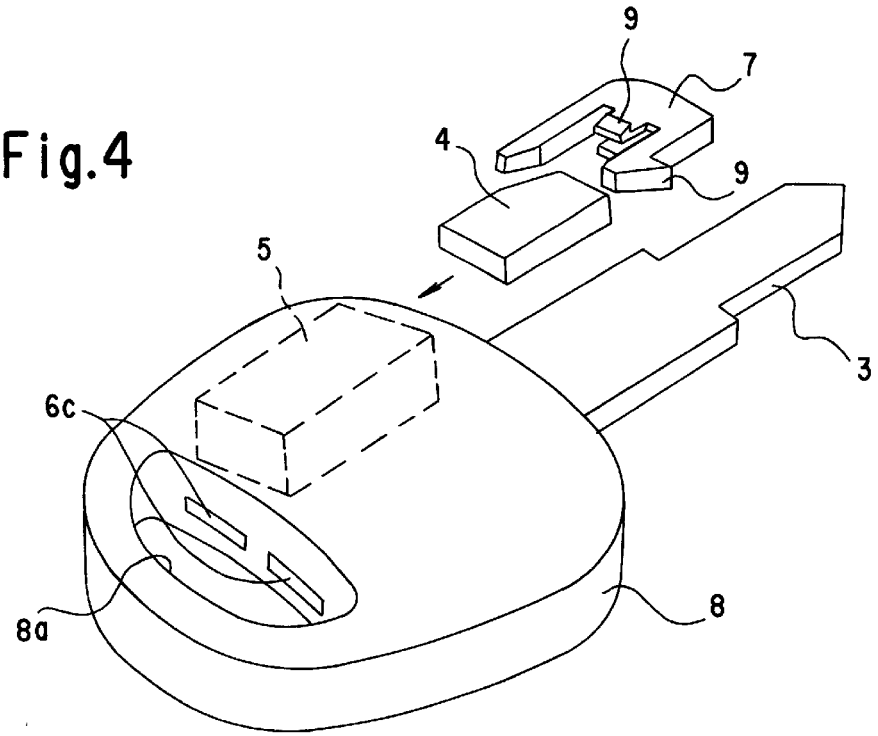
FIG. 4 is an exploded perspective view showing the electronic-component-integrated key of the invention.
Figure 5:
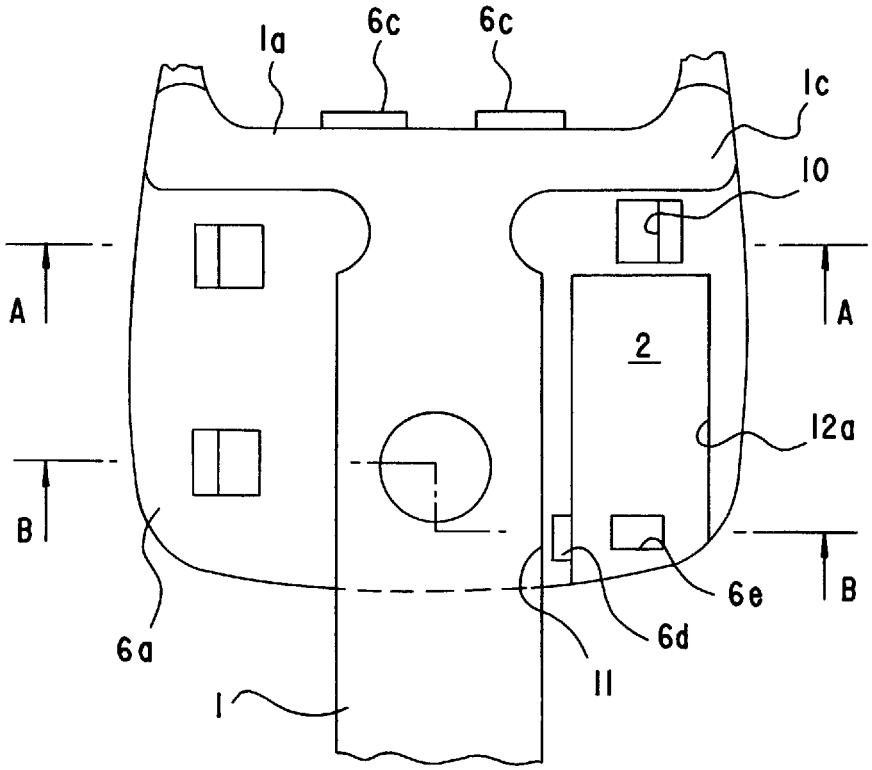
FIG. 5 is a plan view showing a case piece used for the invention.
Figure 6:
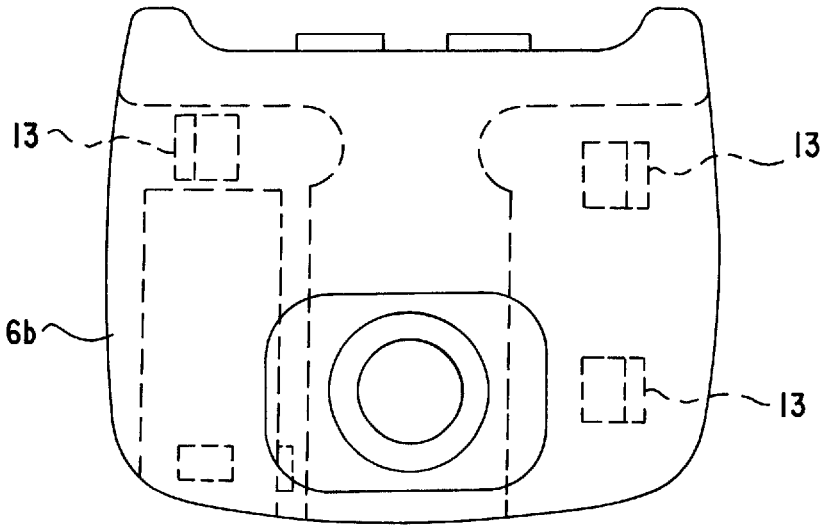
FIG. 6 is a plan view showing the other case piece used for the invention.

The electronic component 4 includes: a substrate, and such electric elements for forming electronic circuits as a coil antenna, capacitors, a battery, a constant voltage circuit, a storage circuit, a signal forming circuit, or an oscillator circuit. Since the outer sheath portion 8 is formed by resin molding after the pair of case pieces 6*a*, 6*b* constituting the inside case portion 6 has been formed and then attached to the key plate 1, the inside case portion 6 can be shaped as desired in this embodiment. As shown in FIG. 4, two abutment portions 6*c* of the inside case portion 6 are partially exposed to an inner surface portion of an opening 8*a* so as to be flush with the outer sheath portion 8, the inner surface portion being on the side of the blade portion 3 and the opening 8*a* being formed on the outer sheath portion 8.

FIG. 13 shows a state in which the openings 8*a* of the heads 2 of a plurality of electronic-component-integrated keys are coupled to each other through a ring 17 to thereby allow one of the electronic-component-integrated keys to be inserted into a steering lock system 15 and operated by gripping the heads 2 of both keys. When one of the electronic-component-integrated keys is inserted into the steering lock system 15 that has an antenna 16 wound, the base of the blade portion and the hood portion 1*c* of the head portion of the key plate 1 are interposed between the electronic component 4 inside the other electronic-component-integrated key and the antenna 16, thereby implementing metal shielding with the key plate 1. Therefore, even if different electromagnetic induction signals 18 are generated from the electronic components 4 of a plurality of electronic-component-integrated keys, almost none of the electromagnetic induction signal of the electronic component 4 at a the lower position is transmitted to the antenna 16, which in turn allows only the electromagnetic induction signal of the electronic component 4 at the upper position to be reliably discriminated through the antenna 16.

Figure 10:
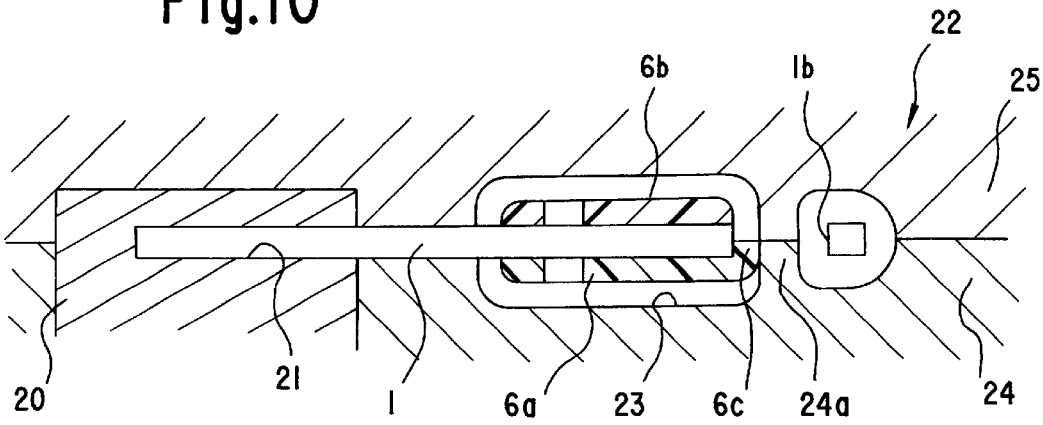
FIG. 10 is a sectional view taken along a line A—A of FIG. 9 with the key plate being inserted into a mold.
Figure 11:
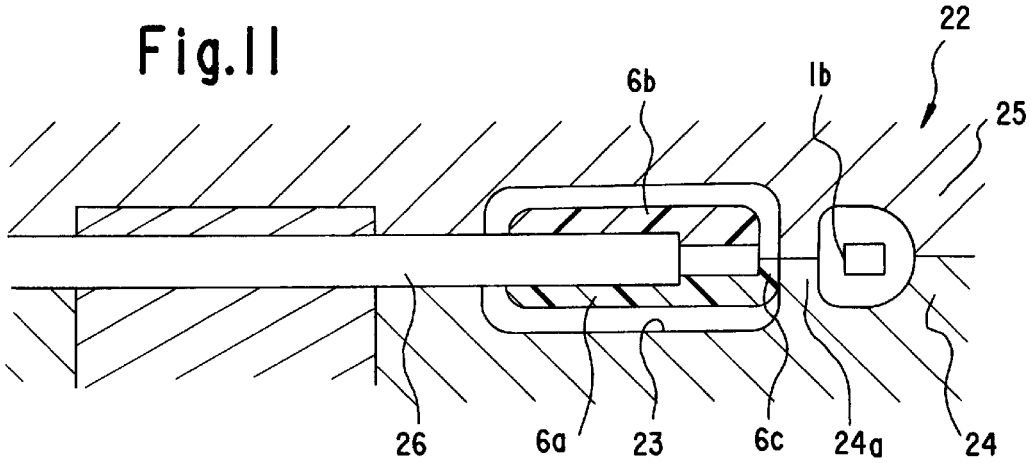
FIG. 11 is a sectional view taken along a line B-A of FIG. 9 with the key plate being inserted into the mold.

Next, a manufacturing method of the electronic-component-integrated key as shown in FIGS. 1 to 4 will be described hereinafter. The key plate 1 is set into a cavity 23 of a mold 22 with the blade portion 3 of the key plate 1 inserted into a receiving hole 21 of a post 20 shown in FIG. 9. While FIGS. 10 and 11 show an example in which a single key plate 1 is inserted into the post 20, multi-cavity molding is implemented during the actual key manufacturing process; i.e., a plurality of key plates are molded while inserted into a plurality of receiving holes 21 of the post 20. The mold 22 has a lower mold 24 and an upper mold 25. The key plate 1 set into the cavity 23 formed by the lower mold 24 and the upper mold 25 is arranged so that not only the abutment portion 6*c* thereof is abutted against a projection 24*a* of the lower mold 24 but also the serrations 3*a* of the blade portion 3 are abutted against the outer surface of the post 20. As a result, the key plate 1 can be fixed to the cavity 23 stably.

Then, a sliding mold 26 is moved into the cavity 23, and an end portion of the sliding mold 26 is inserted into the recessed portion 5 formed by the slots 12*a*, 12*b* of the inside case portion 6. Being abutted against the inner side of the abutment portion 6*c*, the key plate 1 is not moved by the inserting of the sliding mold 26. Further, since a plurality of abutment portions 6*c* are arranged so as to be perpendicular to the sliding mold 26 inserting direction, the key plate 1 does not rotate. When the sliding mold 26 has been inserted into the recessed portion 5, the key plate 1 is retained within the cavity 23 more reliably. The outer sheath portion 8 is thereafter formed over the outside of the inner case portion 6 by charging molten resin into the cavity 23.

Figure 12:
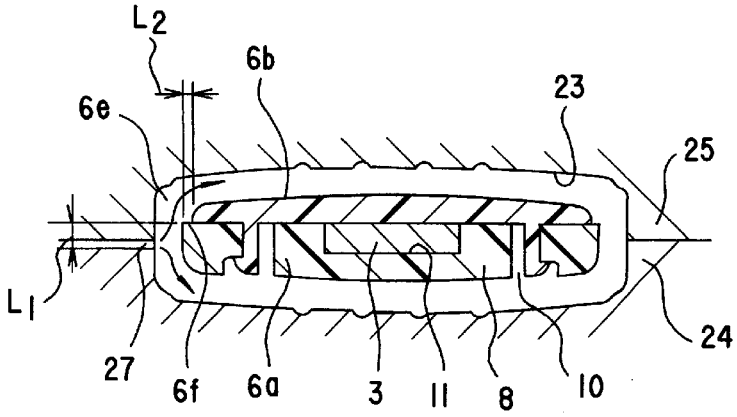
FIG. 12 is a sectional view showing a gate of the mold.

In this case, as shown in FIG. 12, when the inside case portion 6 is attached to the head portion 1*a* of the key plate 1, an $L_2$-long stepped portion 6*f* that is formed by the pair of case pieces 6*a*, 6*b* is positioned in the cavity 23 so as to be displaced from a gate 27 by a distance $L_1$, the gate 27 serving to charge the molten resin to form the outer sheath portion 8. Out of the pair of case pieces 6*a*, 6*b* that forms the stepped portion 6*f*, the case piece 6*a* close to the gate 27 is made thick, whereas the other case piece 6*b* remote from the gate 27 is made thin. Soft resin is charged into the through holes 10 formed in the case piece 6*a*, which is one of the case pieces of the inside case portion 6. Since the stepped portion 6*f* formed at the interface between the case pieces 6*a*, 6*b* is positioned in the cavity 23 so as to be displaced from the gate 27 for charging the molten resin to form the outer sheath portion 8, the molten resin that is injected from the gate 27 at the molten resin injection start is not directly forced into the interface between the pair of case pieces 6*a*, 6*b* (the stepped portion), thereby contributing to reducing the amount of molten resin entering into the interface between the case pieces 6*a*, 6*b*. As a result, the amount of molten resin entering into the recessed portion 5 is likewise reduced, and this prevents repulsive force from being applied to the case pieces 6*a*, 6*b* by the injection pressure, and therefore contributes to giving a desired degree of dimensional accuracy to the recessed portion into which the electronic component 4 is inserted.

Further, since the molten resin for forming the outer sheath portion 8 is charged between the pair of abutment portions 6*c*, there is no gap interposed between the periphery of each abutment portion 6*c* and the outer sheath portion 8. Still further, since the molten resin for forming the outer sheath portion 8 is charged also in the through holes 10, the case pieces 6*a*, 6*b* can be fixed reliably. As the soft resin for forming the outer sheath portion 8, rubber-based resins such as polystyrene butadiene or vinyl chloride resins are used.

After the outer sheath portion 8 has been formed over the outside of the inside case portion 6, not only the sliding mold 26 is removed from the recessed portion 5 of the inside case portion 6, but also the key plate 1 is taken out of the mold 22. Then, after the electronic component 4 has been inserted into the recessed portion 5 of the inside case portion 6, the holder 7 is attached to the recessed portion 5. In this embodiment, the recessed portion 5 is formed on the side of the serrations 3 of the key plate 1, not on the side of the head portion 1*a* of the key plate 1, so as to be substantially parallel with the key plate 1. The holder 7 is arranged so as to confront the key hole of a not shown lock system. Further, the plurality of elastic claws 9 formed on the holder 7 are engaged with the stepped portions 6*d*, 6*e*to make the holder 7 unrelesable from the recessed portion 5.

The electronic component 4 set into the recessed portion 5 of the inside case portion 6 made of hard resin is protected against external force, and the outer sheath portion 8 made of soft resin gives the user an agreeable touch. Further, by engaging the elastic claws 9 formed on the holder 7 with the stepped portions 6*d*, 6*e*of the recessed portion 5 of the inside case portion 6, the holder 7 can be snapped into the head 2 without employing screws. Further, the key plate 1 can be fixed to the cavity stably during molding since the outer sheath portion 8 is injection-molded with the abutment portions 6*c* abutted against the mold 22 during manufacturing, the abutment portions 6*c* being formed so as to be substantially flush with the outer sheath portion 8 that covers the inside case portion 6.

As described in the foregoing, the invention is characterized as allowing the key plate set in the cavity to be resin molded with the key plate 1 reliably held. Therefore, a high-quality key having a head covered with soft resin can be manufactured. In addition, since it is on the opening that the abutment portions are formed, not only the sliding mold can be inserted from the side of the blade portion, but also the insertion hole of the recessed portion can be arranged on the side of the blade portion. Therefore, the electronic component 4 is not damaged by key operations, which in turn contributes to preventing danger.

What is claimed is:

1. An electronic-component-integrated key comprising:

a key plate having a) a blade portion formed at a front end with serrations which serve to give a key code and b) a head portion extending sideways from a rear end of said blade portion;

a head being made of resin and fixed to an end portion of the key plate, said head including an inside case portion being made of hard resin and having a recessed portion located parallel with and adjacent to a side of the blade portion, said recessed portion having a front end extending toward the serrations of the key plate and a rear end located adjacent to the head portion, and an outer sheath portion being fixed to an outside of the inside case portion and being made of soft resin; and an electronic component arranged within the recessed portion of the inside case portion, which is activated by a signal by an antenna outside said key and which is rearwardly shielded by said head portion of the key plate;

wherein abutment portions are formed on the inside case portion and are partially exposed to the outer sheath portion.

2. An electronic-component-integrated key according to claim 1, wherein the electronic component is held by a holder having elastic claws being engaged within the recessed portion of the inside case portion.

3. An electronic-component-integrated key according to claim 1, wherein the inside case portion has a pair of first and second case pieces; said first case piece having elastic claws; said second case piece having through holes; said elastic claws of first case piece are engaged with said through holes to retain the first case piece with the second case piece.

4. An electronic-component-integrated key according to claim 1, wherein the abutment portions of the inside case portion are exposed so as to be substantially flush with the outer sheath portion.

5. An electronic-component-integrated key comprising:

a key plate having a) a blade portion formed at a front end with serrations which serve to give a key code and b) a head portion extending sideways from a rear end of said blade portion;

a head being made of resin and fixed to an end portion of the key plate, said head including an inside case portion being made of hard resin and having a recessed portion located parallel with and adjacent to a side of the blade portion, said recessed portion having a front end extending toward the serrations of the key plate and a rear end located adjacent to a point where the head portion extends sideways from the blade portion, and an outer sheath portion being fixed to an outside of the inside case portion and being made of soft resin; and an electronic component arranged within the recessed portion of the inside case portion, the electronic component being activated by a signal from an antenna outside said key and the electronic component being rearwardly shielded by said head portion of the key plate.

* * * * *